US010274233B2

(12) United States Patent
Jandal et al.

(10) Patent No.: US 10,274,233 B2
(45) **Date of Patent: *Apr. 30, 2019**

(54) REFRIGERANT COOLING AND LUBRICATION SYSTEM WITH REFRIGERANT SOURCE ACCESS FROM AN EVAPORATOR

(71) Applicant: TRANE INTERNATIONAL INC., Davidson, NC (US)

(72) Inventors: Daoud Ali Jandal, La Crosse, WI (US); Brian Thomas Sullivan, La Crosse, WI (US); Reginald Loyd Berry, Onalaska, WI (US); Ronald Allen Boldt, Stoddard, WI (US); Matthew Aron Witt, La Crosse, WI (US); Damion Scott Plymesser, De Soto, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 114 days.

This patent is subject to a terminal disclaimer.

(21) Appl. No.: 15/369,476

(22) Filed: Dec. 5, 2016

(65) Prior Publication Data

US 2017/0146272 A1 May 25, 2017

Related U.S. Application Data

(63) Continuation of application No. 14/763,447, filed as application No. PCT/US2014/013041 on Jan. 24, 2014, now Pat. No. 9,513,038.

(Continued)

(51) Int. Cl.

*F25B 31/00* (2006.01)
*F25B 13/00* (2006.01)

(Continued)

(52) U.S. Cl.

CPC ..... *F25B 31/002* (2013.01); *F04D 29/063* (2013.01); *F25B 1/10* (2013.01);

(Continued)

(58) Field of Classification Search

CPC ..... F25B 13/00; F25B 31/002; F25B 31/006; F25B 49/02; F25B 2400/0403; F25B 2400/13; F25B 2500/26

See application file for complete search history.

(56) References Cited

U.S. PATENT DOCUMENTS 5,465,590 A 11/1995 Van Steenburgh, Jr. et al.
5,761,914 A 6/1998 Carey et al.

(Continued)

FOREIGN PATENT DOCUMENTS

CN 1278904 1/2001
CN 1322289 11/2001

(Continued)

OTHER PUBLICATIONS

International Search Report and Written Opinion for International Application No. PCT/US2014/013041, dated May 28, 2014, 10 pgs.

*Primary Examiner* — Marc E Norman

(74) *Attorney, Agent, or Firm* — Hamre, Schumann, Mueller & Larson, P.C.

(57) ABSTRACT

Generally, apparatuses, systems, and methods are described that are directed to accessing liquid refrigerant from an evaporator to source a refrigerant pump and pump line to cool and lubricate such moving parts that may be part of the compressor, for example the compressor motor and the compressor bearings, and/or for cooling drives such as an adjustable or variable frequency drive.

15 Claims, 3 Drawing Sheets

Related U.S. Application Data

(60) Provisional application No. 61/757,079, filed on Jan. 25, 2013, provisional application No. 61/757,083, filed on Jan. 25, 2013, provisional application No. 61/757,081, filed on Jan. 25, 2013, provisional application No. 61/793,486, filed on Mar. 15, 2013, provisional application No. 61/793,197, filed on Mar. 15, 2013, provisional application No. 61/793,631, filed on Mar. 15, 2013.

(51) Int. Cl.

| | |
|---|---|
| ***F25B 49/02*** | (2006.01) |
| ***F25B 1/10*** | (2006.01) |
| ***F25B 45/00*** | (2006.01) |
| ***F04D 29/063*** | (2006.01) |
| ***F25B 39/00*** | (2006.01) |
| *F01M 5/00* | (2006.01) |
| *F04D 17/10* | (2006.01) |

(52) U.S. Cl.

CPC ..... *F25B 13/00* (2013.01); *F25B 31/008* (2013.01); *F25B 39/00* (2013.01); *F25B 45/00* (2013.01); *F25B 49/02* (2013.01); *F01M 5/002* (2013.01); *F01M 2005/004* (2013.01); *F04D 17/10* (2013.01); *F25B 2339/0242* (2013.01); *F25B 2339/046* (2013.01); *F25B 2339/047* (2013.01); *F25B 2400/0403* (2013.01); *F25B 2400/13* (2013.01); *F25B 2500/01* (2013.01); *F25B 2500/06* (2013.01); *F25B 2500/16* (2013.01); *F25B 2500/26* (2013.01); *F25B 2600/2501* (2013.01); *F25B 2700/19* (2013.01)

(56) References Cited

U.S. PATENT DOCUMENTS

| | | | | |
|---|---|---|---|---|
| 6,050,098 | A | 4/2000 | Meyer et al. | |
| 6,065,297 | A | 5/2000 | Tischer et al. | |
| 6,170,286 | B1 | 1/2001 | Keuper | |
| 6,279,340 | B1 | 8/2001 | Butterworth et al. | |
| 6,293,112 | B1 | 9/2001 | Moeykens et al. | |
| 6,357,239 | B2 | 3/2002 | Carey | |
| 6,516,627 | B2 | 2/2003 | Ring et al. | |
| 6,830,099 | B2 | 12/2004 | Moeykens | |
| 6,868,695 | B1 | 3/2005 | Dingel et al. | |
| 7,421,855 | B2 | 9/2008 | Ring et al. | |
| 7,658,079 | B2 | 2/2010 | Bailey et al. | |
| 8,021,127 | B2 | 9/2011 | De Larminat | |
| 9,513,038 | B2 * | 12/2016 | Jandal | F25B 31/002 |
| 2001/0037651 | A1 | 11/2001 | Butterworth et al. | |
| 2008/0115515 | A1 | 5/2008 | Bailey et al. | |
| 2013/0247599 | A1 | 9/2013 | Love et al. | |
| 2013/0247607 | A1 | 9/2013 | Love et al. | |
| 2014/0345311 | A1 | 11/2014 | Sun et al. | |
| 2015/0362233 | A1 | 12/2015 | Jandal et al. | |

FOREIGN PATENT DOCUMENTS

| | | |
|---|---|---|
| CN | 1322290 | 11/2001 |
| CN | 101949619 | 1/2011 |
| CN | 202560516 | 11/2012 |
| WO | 99-24767 | 5/1999 |

* cited by examiner

REFRIGERANT COOLING AND LUBRICATION SYSTEM WITH REFRIGERANT SOURCE ACCESS FROM AN EVAPORATOR

FIELD

The disclosure herein relates to heating, ventilation, and air-conditioning ("HVAC") or refrigeration systems, such as may include a chiller, and more particularly relates to providing refrigerant to cool the system, such as for cooling moving parts that may be part of the compressor, for example the compressor motor and the compressor bearings, and/or for cooling drives such as an adjustable or variable frequency drive. Generally, methods, systems, and apparatuses are described that are directed to accessing liquid refrigerant from an evaporator to source a refrigerant pump and pump line to cool and lubricate such moving parts that may be part of the compressor, for example the compressor motor and the compressor bearings, and/or for cooling drives such as an adjustable or variable frequency drive.

BACKGROUND

A HVAC or refrigeration system, such as may include a chiller, can include a compressor, a condenser, an evaporator and an expansion device. In a cooling cycle of the HVAC or refrigeration system, the compressor can compress refrigerant vapor, and the compressed refrigerant vapor may be directed into the condenser to condense into liquid refrigerant. The liquid refrigerant can then be expanded by the expansion device and directed into the evaporator. Chiller systems typically incorporate standard components of a refrigeration circuit to provide chilled water for cooling, such as for example building spaces. A typical refrigeration circuit includes a compressor to compress refrigerant gas, a condenser to condense the compressed refrigerant to a liquid, and an evaporator that utilizes the liquid refrigerant to cool water. The chilled water can then be piped to locations for desired end use(s).

Components of the HVAC or refrigeration system, such as the compressor, may include moving parts, and therefore may require lubrication during operation. Lubricants, such as oil, are commonly used in the HVAC or refrigeration system to lubricate the moving parts.

SUMMARY

In some HVAC or refrigeration systems, liquid refrigerant can be used as a lubricant for components with moving parts, such as the moving parts of a compressor, including its motor and bearings therein. At shut off of a chiller, for example, refrigerant tends to migrate to the evaporator such as after and during a period of chiller shut off, so liquid refrigerant can be located in the evaporator. At start up, there can be an issue of whether the refrigerant pump is primed with a suitable and appropriate pressure differential so as to confirm a refrigerant flow through the refrigerant pump. This can be important, for example before starting the compressor of an oil free chiller. If there is not an appropriate pressure differential, the moving parts of the chiller, such as for example the bearings in the compressor, its motor, and the drive could not operate appropriately, can be at risk for damage, and the chiller overall may not function at desired efficiency due to the inadequate or ineffective refrigerant cooling and lubrication of the compressor.

To start the chiller, there may be a need to prime the pump. By shutting off the condenser water pump, the refrigerant pump can be primed, and sourcing can be started for example from the evaporator to establish refrigerant flow and an appropriate pressure differential. A signal can be obtained that there is an appropriate pressure differential so to allow refrigerant to be delivered to the refrigerant pump and to allow the compressor to be started and also the condenser water pump. While this solution may be a possibility, it is not always practical to turn off the condenser water pump, if for example an HVAC or refrigeration system has multiple chillers, and there are certain areas of the system that could be impacted based on the system design.

Improvements can be made to provide liquid refrigerant to the moving parts during startup. Generally, apparatuses, systems, and methods are described that are directed to accessing liquid refrigerant from an evaporator to source a refrigerant pump and pump line to cool and lubricate such moving parts that may be part of the compressor, for example the compressor motor and the compressor bearings, and/or for cooling drives such as an adjustable or variable frequency drive.

For example during a startup or restart of the compressor, liquid refrigerant may be sourced from the evaporator by opening a source valve on the evaporator source line. Once confirmation is given that there exists an appropriate pressure differential, e.g. $\Delta p$, this confirmation can be done by using a unit controller that receives a signal from one or more appropriately positioned pressure transducers, such as along the refrigerant pump line. Once, $\Delta p$ is established, which in some examples can be about 2 psi, there can be confirmation that there would be sufficient refrigerant flow to the compressor, so liquid refrigerant can flow to parts that may be in need of lubrication. Then the unit controller can start the compressor. After starting the compressor, there can be liquid refrigerant from operation of the condenser, so that the unit controller can close the source valve on the evaporator source line and open a source valve on the condenser source line, so that liquid refrigerant sourcing can be from the condenser.

Hereafter the term "source valve" is generally meant as a flow control device that allows or does not allow refrigerant into the refrigerant pump and refrigerant pump line. In some embodiments, any one or more of the source valves can be solenoid valves controlled by a unit controller.

In one embodiment, an evaporator access is disposed proximate a lower portion of an evaporator shell and is fluidly connected to an outlet through the evaporator shell. The evaporator access can allow liquid refrigerant to be sourced from the evaporator shell to the refrigerant pump line and refrigerant pump. In some embodiments, the evaporator access is disposed external to a refrigerant distributor of the evaporator, and may be disposed relatively at a middle portion of the longitudinal direction of the evaporator shell and/or the refrigerant distributor. In some embodiments, the evaporator access and outlet can be fluidly connected to a refrigerant cooling and lubrication assembly.

In one embodiment, a refrigerant cooling and lubrication assembly which may be used in an HVAC or refrigeration system and/or HVAC or refrigeration unit, such as a water chiller, can include a condenser source line, an evaporator source line, a refrigerant pump line, and a refrigerant pump. The condenser source line and the evaporator source line are fluidly connected and can feed into the refrigerant pump line. The refrigerant pump is located on the refrigerant pump line, which can be connected to a compressor motor. On the condenser source line, a source valve is disposed that can have an open state and a closed state. On the evaporator source line, a source valve is disposed that can have an open state and a closed state. The source valve on the condenser source line is configured to decouple the condenser from the refrigerant cooling and lubrication assembly in the closed state, such as during a compressor startup condition, and is configured to allow refrigerant flow from the condenser to flow through the condenser source line in the open state. The source valve disposed on the condenser source line allows for the condenser to be decoupled, such as for example the effects of its water pump, if in operation, does not adversely effect on the lubrication and cooling of the compressor, such as at startup.

By the term "decouple", "decouples", or "decoupled", it is to be appreciated that such terms are meant and intended as generally stopping fluid flow from one component to another component. For example, to decouple the condenser from a pump source line or feed can be accomplished by activating a flow control device, such as along the condenser source line, to an off state to stop fluid flow, e.g. refrigerant vapor, from entering the feed or source line to the pump and flowing to the pump. Such effect can help to avoid or at least reduce an educator/jet-like or accelerated fluid flow, which may be susceptible to entraining vapor into a relatively lower or middle pressure flow (e.g. bringing vapor into suction), which may not be desirable for pump operation, e.g. may result in pump cavitation(s).

In one embodiment, the evaporator source line can be fluidly connected to the evaporator access so as to allow connection of the refrigerant cooling and lubrication assembly.

Other features and aspects of the fluid management approaches will become apparent by consideration of the following detailed description and accompanying drawings.

BRIEF DESCRIPTION OF THE DRAWINGS

Reference is now made to the drawings in which like reference numbers represent corresponding parts throughout.

DETAILED DESCRIPTION

A HVAC or refrigeration system, such as may include a chiller system, may commonly include components with moving parts, such as a compressor. The moving parts generally require proper lubrication. The lubrication is commonly provided by lubricants, such as oil. In some HVAC or refrigeration systems, the lubrication can be provided by liquid refrigerant. Such a HVAC or refrigeration system is sometimes called an oil-free system. In the oil-free system, liquid refrigerant can be directed to surfaces of the moving parts for lubrication. Improvements can be made to direct liquid refrigerant to the moving parts when, for example, the HVAC or refrigeration system such as may include a chiller that starts from an off cycle. Such startup conditions of the compressor may be due, for example but are not limited to, a shut off occurring during periodic schedules such as in comfort cooling applications, and/or servicing or testing of one or more of the chillers in a larger system scheme, and/or a power surge or outage.

The embodiments as disclosed herein describe methods and systems that are directed to accessing liquid refrigerant from an evaporator to source a refrigerant pump and pump line to cool and lubricate such moving parts that may be part of the compressor, for example the compressor motor and the compressor bearings, and/or for cooling drives such as an adjustable or variable frequency drive.

Figure 1:
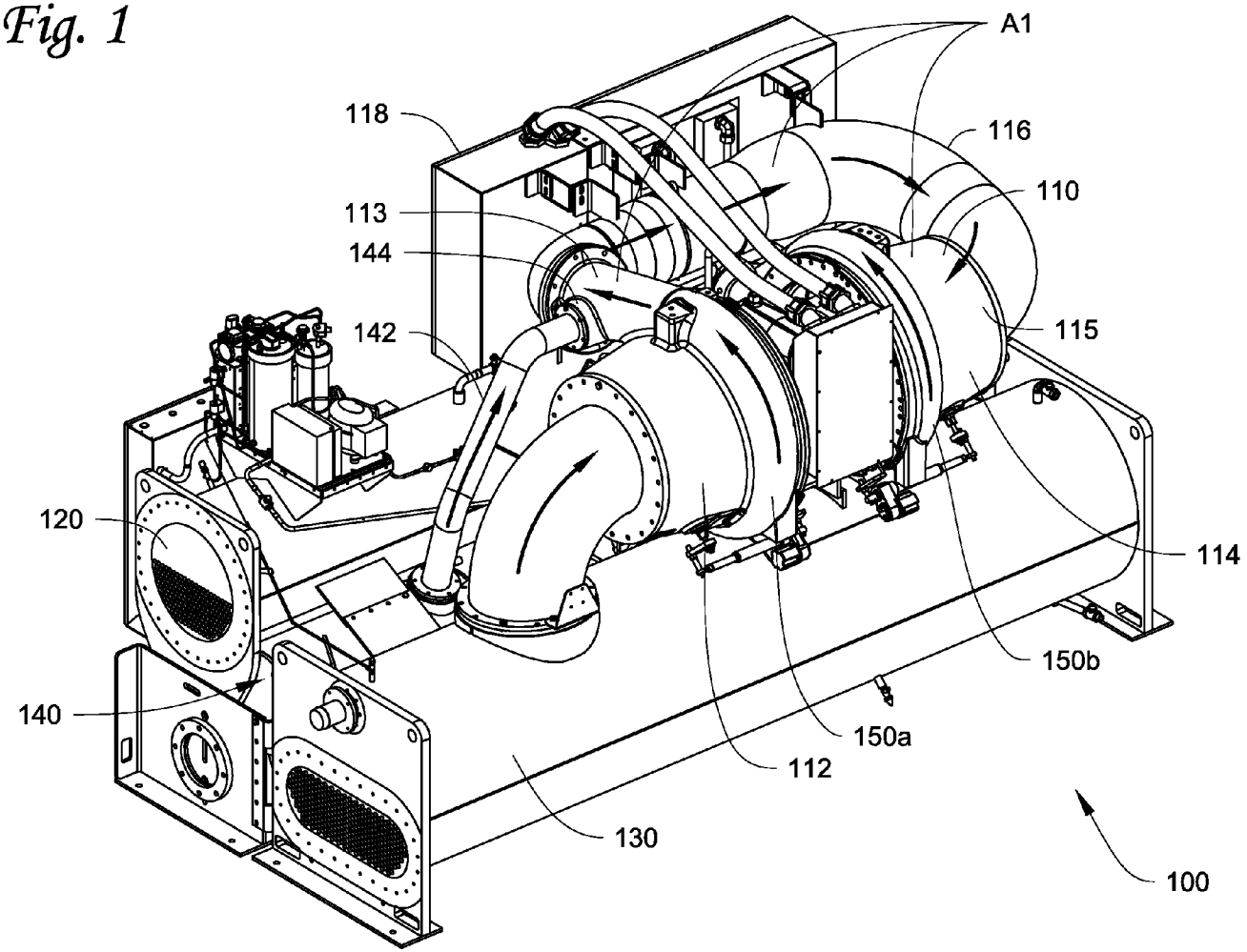
FIG. 1 illustrates a perspective view of one example of chiller, in particular a centrifugal water chiller, according to one embodiment.

FIG. 1 illustrates a perspective view of one example of chiller 100, such as for an HVAC or refrigeration system according to one embodiment. In particular, FIG. 1 shows a water chiller with a centrifugal compressor, e.g. a centrifugal chiller.

In the embodiment shown, the chiller 100 includes a compressor 110 that is configured to have a first compression stage 112 and a second compression stage 114. The compressor 110 can be a centrifugal compressor. It will be appreciated that the type of chiller is merely exemplary and not meant to be limiting, as other chiller types that may use other types of compressors may suitably employ and implement the refrigerant pump priming and refrigerant sourcing approaches shown and described herein. It will also be appreciated that the number of stages of compression is merely exemplary, and that more or less than two stages of compression may be suitably implemented with the refrigerant pump priming and refrigerant sourcing approaches shown and described herein, as long as for example such compression components and moving parts that may be in need of refrigerant lubrication and cooling are configured to receive refrigerant provided from the refrigerant pump.

In some examples, the chiller 100 can be one of many chillers in an overall system that has a heat rejection unit, such as a cooling tower, where one or more condenser water pumps may be used to run water through the condensers of the chillers to reject heat to the environment from the chillers.

With further reference to the general structure of the chiller 100 shown in FIG. 1, the first compression stage 112 and the second compression stage 114 include a first volute 150*a* and a second volute 150*b* respectively. The chiller 100 also includes a condenser 120, an evaporator 130 and an economizer 140. A run-around pipe 116 is configured to fluidly connect the first compression stage 112 to the second compression stage 114 to form fluid communication between the first compression stage 112 and the second compression stage 114. The run-around pipe 116 is fluidly connected to a discharge exit 113 of the first compression stage 112 and an inlet 115 of the second compression stage 114. The discharge exit 113 is in fluid communication with the first volute 150*a*. The run-around pipe 116, the discharge exit 113 and the inlet 113 form a refrigerant conduit A1, which is configured to direct a refrigerant flow. The economizer 140 is configured to have an injection pipe 142 forming fluid communication with the refrigerant conduit Al through an injection port 144. The injection pipe 142 is configured to direct vaporized flash refrigerant from the economizer 140 to the injection port 144.

Refrigerant flow directions when the chiller 100 is in operation are generally illustrated by the arrows. The refrigerant flow directions are typically in accordance with refrigerant passages, such as defined by the refrigerant conduit Al and the first and second volutes 150*a*, 150*b*. In operation, refrigerant vapor from the evaporator 130 can be directed into the first compression stage 112. A first impeller (not shown in FIG. 1) located in the first compression stage 112 can compress the refrigerant vapor from the evaporator 130. The compressed refrigerant vapor can be collected by the volute 150*a* and directed into the refrigerant conduit Al. The compressed refrigerant is directed into the inlet 115 of the second compression stage 114 along the refrigerant conduit Al. In the second compression stage 116, a second impeller (not shown in FIG. 1) can be configured to further compress the refrigerant and then direct the compressed refrigerant into the condenser 120 through the second volute 150*b*. In the condenser 120, the compressed refrigerant may be condensed into liquid refrigerant. The liquid refrigerant leaving the condenser 120 is then directed into the evaporator 130.

The chiller 100 can also have a section 118 having a unit controller that controls certain valves and/or receives input(s) from sensors, transducers on the chiller 100, such as any one or more of the valves and/or sensors on the refrigerant cooling and lubrication assembly 200 described below. The section 118 can also contain or be connected to the unit drive of the chiller 100.

In one embodiment, the controller can be operatively connected to a refrigerant cooling and lubrication assembly to provide liquid refrigerant to a pump, which thereafter can deliver liquid refrigerant to moving parts of the chiller, such as for example the compressor.

Figure 2:
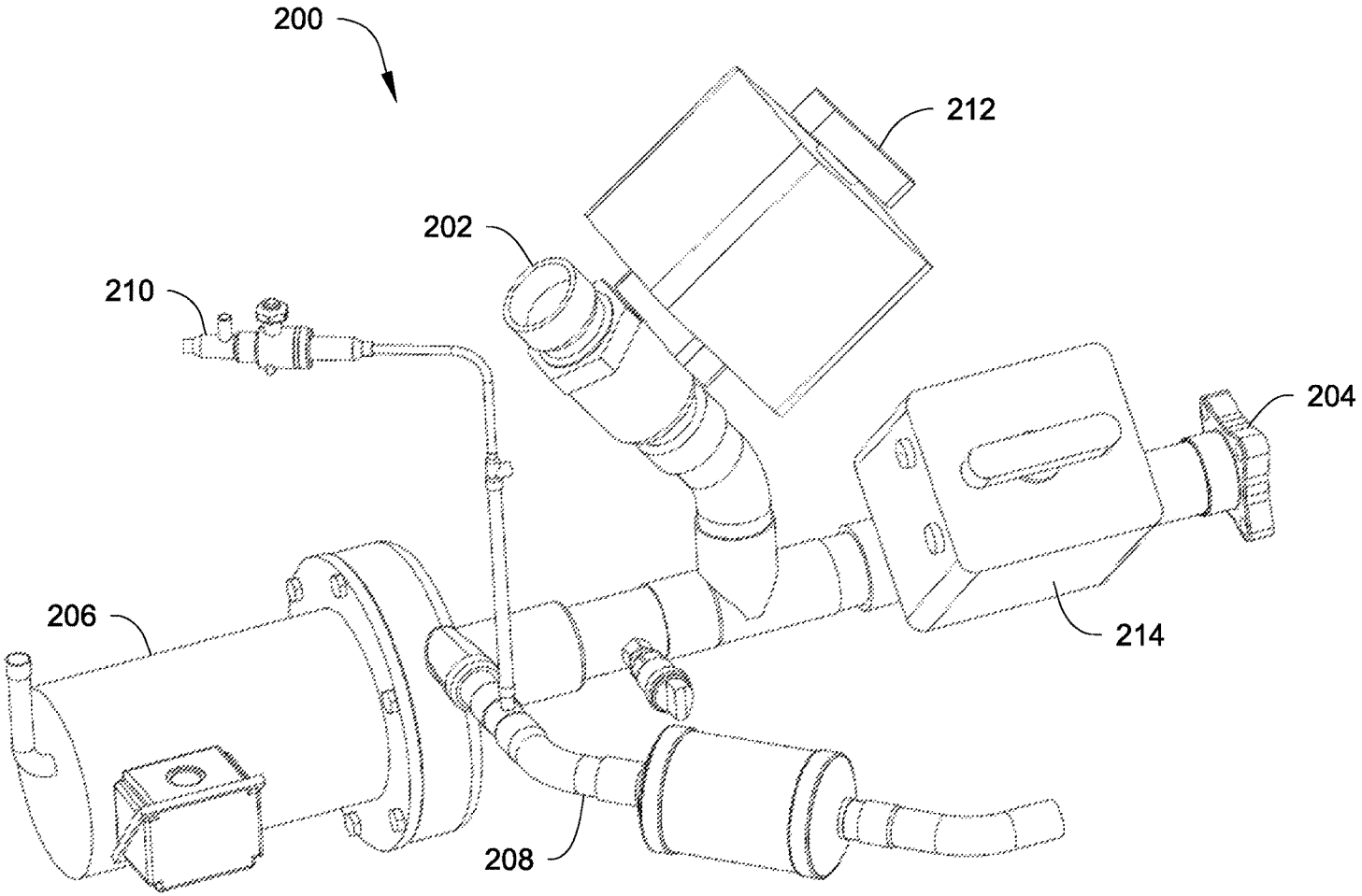
FIG. 2 shows one embodiment of a refrigerant cooling and lubrication assembly which may be implemented as part of a chiller system or unit.

FIG. 2 shows one embodiment of a refrigerant cooling and lubrication assembly 200 which may be implemented as part of a chiller system or unit, such as the chiller 100 shown in FIG. 1. The refrigerant cooling and lubrication assembly 200 may be appropriately piped into the condenser and evaporator, e.g. 120 and 130 in FIG. 1, so as to source refrigerant therefrom to the compressor, e.g. 110.

In one embodiment, a refrigerant cooling and lubrication assembly 200 which may be used in an HVAC or refrigeration system and/or HVAC or refrigeration unit, such as the water chiller 100, can include a condenser source line 202, an evaporator source line 204, a refrigerant pump line 208, and a refrigerant pump 206. The condenser source line 202 and the evaporator source line 204 are fluidly connected and can feed into the refrigerant pump line 208. The refrigerant pump 206 is located on the refrigerant pump line 208, which can be connected to a compressor motor, e.g. the compressor 110 of FIG. 1. On the condenser source line 202, a source valve 212 is disposed that can have an open state and a closed state. On the evaporator source line 204, a source valve 214 is disposed that can have an open state and a closed state. The source valve 212 on the condenser source line 202 is configured to decouple the condenser, e.g. condenser 120 from the refrigerant cooling and lubrication assembly 200 in the closed state, such as during a compressor startup condition, and is configured to allow refrigerant flow from the condenser to flow through condenser source line 202 in the open state. The source valve 212 disposed on the condenser source line 202 allows for the condenser to be decoupled, such as for example the effects of a water pump in operation, so that there is no adverse effect on the lubrication and cooling of the compressor, such as at startup. A valve and line 210 can be fluidly connected to the refrigerant pump line 208 so as to allow refrigerant delivery to the drive of a chiller, e.g. chiller 100.

In operation, for example, the assembly 200 can prime the pump even in conditions where the condenser water pump may be running, e.g. such as when the condenser or another condenser in the system may still be active. For example, in one embodiment, the source valve 212 on the condenser source line 202 to the refrigerant pump 206 is shut off, which isolates or decouples the condenser from the refrigerant cooling and lubrication function of the compressor and drive. The shut off of the source valve 212 can be by a signal from the unit controller to the source valve 212. The refrigerant pump 206 can be primed, for example by turning on the refrigerant pump 206 and activating the source valve 214 on the evaporator source line 204 to an open position, which can allow sourcing of liquid refrigerant to the refrigerant pump 206. The activation of the source valve 214 on the evaporator source line 204 can be by a signal from the unit controller to turn the source valve 214 on. Once an appropriate $\Delta p$ is established, such as at about 2 psi, the unit may be started, and then the source valve 214 on the evaporator source line can be shut off, such as by the unit controller receiving a signal from a transducer(s), which the controller can signal the source valve 214 to turn off. The source valve 212 on the condenser source line 202 may receive a signal to turn on so that sourcing can then be from the condenser.

It will be appreciated that any one or more of the evaporator source line 204, the evaporator source valve 214, line to refrigerant pump 206, and refrigerant pump 206, may tilt downward such as in the orientation shown in FIG. 2 toward the refrigerant pump to facilitate two phase refrigerant separation to allow the vapor refrigerant to rise to the top of the fluid flow path through any one or more of the evaporator source line 204, evaporator source valve 214, line to the refrigerant pump 206, and refrigerant pump, and to flow back to the evaporator and to allow the liquid refrigerant to flow down to the suction of the refrigerant pump. This can allow the two phase refrigerant separation to supply the pump with relatively higher concentration of liquid refrigerant, which can prevent cavitations and further help priming of the refrigerant pump 206.

Figure 3A:
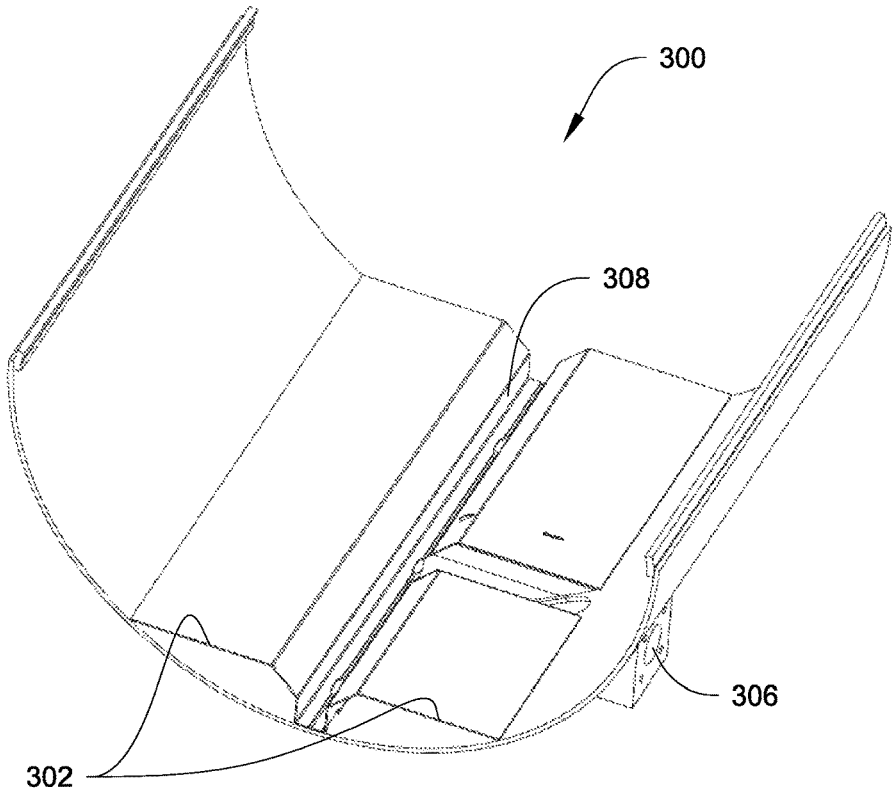
FIG. 3A shows one embodiment of an evaporator access that may be implemented in a refrigerant cooling and lubrication assembly and chiller.
Figure 3B:
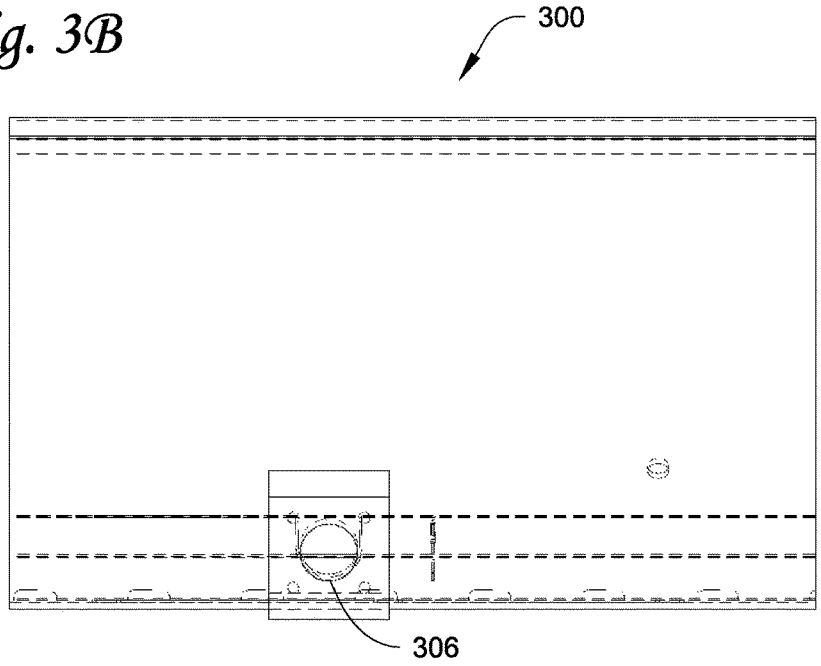
FIG. 3B shows a side view of the evaporator access of FIG. 3A.

FIGS. 3A and 3B show one embodiment of an evaporator access that may be implemented in a refrigerant cooling and lubrication assembly, e.g. 200 in FIG. 2, and a chiller, e.g. 100 in FIG. 1. It will be appreciated that the evaporator source line 204 may be in fluid communication with the evaporator access. In general, an evaporator access may be disposed at a lower portion 308 of the evaporator 300 such as at a lower portion of the refrigerant distributor 302, if present. In some embodiments the access includes a notch 304. In the embodiment shown, notch 304 can be a trough, a "U", or suitable recess located external to the distributor 302. It will be appreciated that a pipe can be in this position, rather than the notch 304, to fluidly access the lower portion 308 of the distributor 302. The notch 304 can allow sourcing from the lower portion 308 of the distributor 302 and allow liquid refrigerant to fall into a channel made by the notch 304 to the outlet 306. In some embodiments the notch 304 may have sidewalls that taper toward each other to form a V toward the bottom of the shell of the evaporator 300. It will be appreciated that the access is not limited to including the notch 304, so long as the access is located in a relatively lower portion of the evaporator 300 to fluidly access available liquid refrigerant. In some embodiments the access may be external of the distributor 302 such as shown, but may also be a pipe extending through the distributor 302 to the lower portion 308.

In some embodiments, the notch 304 may be placed in a middle area relative to the longitudinal length of the distributor 302. However, it will be appreciated that the notch 304 may be suitably placed at a location where there may be relatively higher amount of liquid refrigerant to draw from. It will also be appreciated that the access may suitably have more than one notch as desired and/or needed. The access further includes an outlet 306, which is fluidly connected with the notch 304 through the shell of the evaporator 300 (see e.g. dashed line between notch 304 and the outlet 306). As shown, the outlet 306 can be about the same plane as the bottom of the shell of the evaporator 300 so that the height of the evaporator component or overall chiller unit is not increased or at least only minimally increased.

Aspects

It will be appreciated that any of aspects 1 to 16 may be combined with any of aspects 16 to 18, and that any of aspects 16 and 17 may be combined with aspect 18.

Aspect 1. A heating, ventilation, air conditioning (HVAC) unit for an HVAC system comprising: a compressor having a motor and a drive; a condenser fluidly connected to the compressor; an evaporator fluidly connected to the condenser; a unit controller; a refrigerant cooling and lubrication assembly that comprises: a condenser source line fluidly connected to the condenser, an evaporator source line fluidly connected to the evaporator, a refrigerant pump line fluidly connected to the condenser source line and fluidly connected to the evaporator source line, the condenser source line and the evaporator source line feed into the refrigerant pump line, the refrigerant pump line is fluidly connected to at least one of the motor and the drive of the compressor, a refrigerant pump located on the refrigerant pump line, the refrigerant pump having an inlet and an outlet fluidly connected with the refrigerant pump line, and a flow control device disposed on the condenser source line, the flow control device disposed on the condenser source line having an open state and a closed state, a flow control device disposed on the evaporator source line, the flow control device disposed on the evaporator source line having an open state and a closed state; and an evaporator access disposed proximate a lower portion of the evaporator and fluidly connected to an outlet of the evaporator, the evaporator access is fluidly connected to the refrigerant cooling and lubrication assembly through the evaporator source line.

Aspect 2. The HVAC unit of aspect 1, wherein during a startup condition of the compressor, the unit controller is configured to activate the flow control device disposed on the condenser source line to the closed state, where the flow control device disposed on the condenser source line in the closed state is configured to decouple the condenser from the refrigerant cooling and lubrication assembly, and the unit controller is configured to activate the flow control device disposed on the evaporator source line to an open state, the evaporator source line configured to direct a flow of refrigerant from the evaporator access of the evaporator to the refrigerant cooling and lubrication assembly.

Aspect 3. The HVAC unit of aspect 1 or 2, wherein during an operating condition of the compressor, the unit controller is configured to activate the flow control device disposed on the condenser source line to direct refrigerant from the condenser through the condenser source line and through the refrigerant pump line and refrigerant pump to at least one of the motor and the drive of the compressor to cool at least one of the motor and the drive of the compressor.

Aspect 4. The HVAC unit of any of aspects 1 to 3, wherein the controller is configured to receive an input from a sensor to determine whether an appropriate pressure differential is present in the refrigerant pump line, in order to activate the flow control device disposed on the condenser source line to direct refrigerant to the compressor.

Aspect 5. The HVAC unit of any of aspects 1 to 4, wherein at least one of the flow control device disposed on the condenser source line and disposed on the evaporator source line is a solenoid valve.

Aspect 6. The HVAC unit of any of aspects 1 to 5, wherein the evaporator comprises a refrigerant distributor, the evaporator access being disposed external to the refrigerant distributor.

Aspect 7. The HVAC unit of aspect 6, wherein the evaporator access is disposed relatively at a middle portion of a longitudinal direction of the refrigerant distributor.

Aspect 8. The HVAC unit of any of aspects 1 to 7, wherein the evaporator access is disposed relatively at a middle portion of a longitudinal direction of the evaporator.

Aspect 9. The HVAC unit of any of aspects 1 to 8, wherein the evaporator access comprises a notch disposed in the evaporator.

Aspect 10. The HVAC unit of any of aspects 9, wherein the notch comprises sidewalls that taper toward each other.

Aspect 11. The HVAC unit of any of aspects 1 to 10, wherein the evaporator access comprises a pipe configured to fluidly access the evaporator.

Aspect 12. The HVAC unit of any of aspects 1 to 11, wherein the outlet of the evaporator is arranged to be at about the same plane as a bottom of the evaporator.

Aspect 13. The HVAC unit of any of aspects 1 to 12, wherein any one or more of the evaporator source line, the evaporator source valve, the refrigerant pump line, and the refrigerant pump is tilted downward so as to be oriented to allow vapor refrigerant to rise to a top of the fluid flow path through one or more of the evaporator source line, the evaporator source valve, the refrigerant pump line, and the refrigerant pump and flow back to the evaporator, while to allow liquid refrigerant to flow to the refrigerant pump.

Aspect 14. The HVAC unit of any of aspects 1 to 13, wherein the HVAC unit is a water chiller.

Aspect 15. The HVAC unit of any of aspects 1 to 14, wherein the HVAC unit is an oil free water chiller.

Aspect 16. A method of priming a refrigerant pump of a refrigerant cooling and lubrication assembly comprising: determining, with a unit controller, whether a compressor startup condition exists; activating, with the unit controller, a flow control device disposed on a condenser source line to a closed state, and decoupling a condenser, which is fluidly connected to the condenser source line, from a refrigerant pump and a refrigerant pump line; activating, with the unit controller, a flow control device disposed on an evaporator source line to an open state; sourcing refrigerant from the evaporator through an evaporator access; and directing refrigerant from the evaporator through the evaporator access, through the evaporator source line, and through the flow control device disposed on the evaporator source line, and pressurizing the refrigerant pump line.

Aspect 17. The method of aspect 16, further comprising receiving by the unit controller an input from a sensor, and determining with the unit controller whether there is an appropriate pressure differential present along the refrigerant pump line, in order to activate the flow control device disposed on the condenser source line to an open state, and to activate the flow control device disposed on the evaporator source line to a closed state.

Aspect 18. A method of lubricating a compressor of an HVAC system, comprising: activating, with a unit controller, a flow control device disposed on an evaporator source line to an open state, and pressurizing a refrigerant pump line with refrigerant flow from the evaporator source line, which is fluidly connected to an evaporator; accessing refrigerant from the evaporator through an evaporator access; receiving by the unit controller an input from a sensor, and determining with the unit controller whether there is an appropriate pressure differential present along the refrigerant pump line, in order to activate a flow control device disposed on a condenser source line to direct refrigerant to a compressor; activating, with the unit controller, the flow control device disposed on the condenser source line to an open state, when the appropriate pressure differential is determined by the unit controller to be present along the refrigerant pump line; activating, with the unit controller, the flow control device disposed on the evaporator source line to a closed state; and starting the compressor and lubricating at least one of a motor and a drive of the compressor by delivering refrigerant from the condenser source line, which is fluidly connected to a condenser, so as to source refrigerant from the condenser.

With regard to the foregoing description, it is to be understood that changes may be made in detail, without departing from the scope of the present invention. It is intended that the specification and depicted embodiments are to be considered exemplary only.

The invention claimed is:

1. A heating, ventilation, air conditioning (HVAC) unit for an HVAC system comprising:

a compressor having a motor and a drive;

a condenser fluidly connected to the compressor;

an evaporator fluidly connected to the condenser;

a controller;

a refrigerant cooling and lubrication assembly that comprises:

a condenser source line fluidly connected to the condenser, an evaporator source line fluidly connected to the evaporator, a refrigerant pump line fluidly connected to the condenser source line and fluidly connected to the evaporator source line, the condenser source line and the evaporator source line feed into the refrigerant pump line, the refrigerant pump line is fluidly connected to at least one of the motor and the drive of the compressor, a refrigerant pump located on the refrigerant pump line, the refrigerant pump having an inlet and an outlet fluidly connected with the refrigerant pump line, and a flow control device disposed on the condenser source line, the flow control device disposed on the condenser source line having an open state and a closed state; and an evaporator access disposed proximate a lower portion of the evaporator and fluidly connected to an outlet of the evaporator, the evaporator access is fluidly connected to the refrigerant cooling and lubrication assembly through the evaporator source line, wherein the controller is configured to receive an input from a sensor to determine whether an appropriate pressure differential is present in the refrigerant pump line, in order to activate the flow control device disposed on the condenser source line to direct refrigerant to the compressor.

2. The HVAC unit of claim 1, wherein during an operating condition of the compressor, the controller is configured to activate the flow control device disposed on the condenser source line to direct refrigerant from the condenser through the condenser source line and through the refrigerant pump line and refrigerant pump to at least one of the motor and the drive of the compressor to cool at least one of the motor and the drive of the compressor.

3. The HVAC unit of claim 1, wherein the evaporator comprises a refrigerant distributor, the evaporator access being disposed external to the refrigerant distributor.

4. The HVAC unit of claim 3, wherein the evaporator access is disposed relatively at a middle portion of a longitudinal direction of the refrigerant distributor.

5. The HVAC unit of claim 1, wherein the evaporator access is disposed relatively at a middle portion of a longitudinal direction of the evaporator.

6. The HVAC unit of claim 1, wherein the evaporator access comprises a notch disposed in the evaporator.

7. The HVAC unit of claim 6, wherein the notch comprises sidewalls that taper toward each other.

8. The HVAC unit of claim 1, wherein the evaporator access comprises a pipe configured to fluidly access the evaporator.

9. The HVAC unit of claim 1, wherein the outlet of the evaporator is arranged to be at about the same plane as a bottom of the evaporator.

10. The HVAC unit of claim 1, wherein the HVAC unit is a water chiller.

11. The HVAC unit of claim 1, wherein the HVAC unit is an oil free water chiller.

12. The HVAC unit of claim 1, wherein the refrigerant cooling and lubrication assembly further comprises a flow control device disposed on the evaporator source line, the flow control device disposed on the evaporator source line having an open state and a closed state.

13. The HVAC unit of claim 12, wherein during a startup condition of the compressor, the controller is configured to activate the flow control device disposed on the condenser source line to the closed state, where the flow control device disposed on the condenser source line in the closed state is configured to decouple the condenser from the refrigerant cooling and lubrication assembly, and the controller is configured to activate the flow control device disposed on the evaporator source line to the open state, the evaporator source line configured to direct a flow of refrigerant from the evaporator access of the evaporator to the refrigerant cooling and lubrication assembly.

14. The HVAC unit of claim 12, wherein at least one of the flow control device disposed on the condenser source line and disposed on the evaporator source line is a solenoid valve.

15. The HVAC unit of claim 12, wherein any one or more of the evaporator source line, the flow control device disposed on the evaporator source line, the refrigerant pump line, and the refrigerant pump is tilted downward so as to be oriented to allow vapor refrigerant to rise to a top of the fluid flow path through one or more of the evaporator source line, the flow control device disposed on the evaporator source line, the refrigerant pump line, and the refrigerant pump and flow back to the evaporator, while to allow liquid refrigerant to flow to the refrigerant pump.

* * * * *